US011215325B2

(12) United States Patent
Roys

(10) Patent No.: US 11,215,325 B2
(45) Date of Patent: Jan. 4, 2022

(54) MODULAR LED LAMP SYSTEM

(71) Applicant: Curtis Alan Roys, Fredericksburg, TX (US)

(72) Inventor: Curtis Alan Roys, Fredericksburg, TX (US)

( * ) Notice: Subject to any disclaimer, the term of this patent is extended or adjusted under 35 U.S.C. 154(b) by 0 days.

(21) Appl. No.: 16/820,083

(22) Filed: Mar. 16, 2020

(65) Prior Publication Data

US 2020/0284399 A1 Sep. 10, 2020

Related U.S. Application Data

(62) Division of application No. 29/650,957, filed on Jun. 11, 2018, now Pat. No. Des. 878,637.

(60) Provisional application No. 62/838,105, filed on Apr. 24, 2019.

(51) Int. Cl.

| | |
|---|---|
| ***F21K 9/232*** | (2016.01) |
| ***F21K 9/235*** | (2016.01) |
| ***F21K 9/238*** | (2016.01) |
| ***F21V 23/06*** | (2006.01) |
| ***F21V 15/01*** | (2006.01) |
| ***F21Y 107/30*** | (2016.01) |
| ***F21Y 115/10*** | (2016.01) |

(52) U.S. Cl.

CPC ..... *F21K 9/232* (2016.08); *F21K 9/235* (2016.08); *F21K 9/238* (2016.08); *F21V 15/012* (2013.01); *F21V 23/06* (2013.01); *F21Y 2107/30* (2016.08); *F21Y 2115/10* (2016.08)

(58) Field of Classification Search

CPC ..... F21K 9/232; F21K 9/235; F21K 9/238; F21Y 2107/30; F21Y 2107/50; F21Y 2107/60; F21S 2/005; F21V 23/006; F21V 23/02; F21V 19/006; F21V 19/0065; F21V 19/007; F21V 17/14; F21V 23/009

See application file for complete search history.

(56) References Cited

U.S. PATENT DOCUMENTS

| | | | | |
|---|---|---|---|---|
| 5,577,832 | A * | 11/1996 | Lodhie | F21K 9/23 362/249.03 |
| 5,669,703 | A * | 9/1997 | Wheeler | F21V 19/006 362/249.04 |
| 5,806,965 | A * | 9/1998 | Deese | H05B 45/37 362/249.04 |
| D542,943 | S | 5/2007 | Wang | |
| D549,854 | S | 8/2007 | Takahashi | |
| D582,578 | S | 12/2008 | Tsai et al. | |
| D594,995 | S | 6/2009 | Komar | |
| D647,226 | S | 10/2011 | Huang et al. | |
| D669,200 | S | 10/2012 | Chen et al. | |
| D687,982 | S | 8/2013 | Leahy et al. | |

(Continued)

OTHER PUBLICATIONS

U.S. Appl. No. 29/650,957, filed Jun. 11, 2018, Curtis Alan Roys.

*Primary Examiner* — Jong-Suk (James) Lee
*Assistant Examiner* — James M Endo
(74) *Attorney, Agent, or Firm* — Scheinberg & Associates, PC; Michael O. Scheinberg

(57) ABSTRACT

A modular LED lamp system allows for stacking multiple LED carriers to provide the desired amount of light. Each LED carrier preferably includes its own transformer to convert line voltage to power useable by the LEDs on the carrier. Line voltage is conducted through each module to a subsequent module and is provided to the transformer.

5 Claims, 29 Drawing Sheets

(56) References Cited

U.S. PATENT DOCUMENTS

| | | | | |
|---|---|---|---|---|
| D739,968 | S | 9/2015 | Qin | |
| D739,970 | S | 9/2015 | Qin | |
| D753,322 | S | 4/2016 | Taylor | |
| D762,884 | S | 8/2016 | Shalvi | |
| D782,082 | S | 3/2017 | Shalvi | |
| 2004/0022057 | A1* | 2/2004 | Lee | G08G 1/095 362/238 |
| 2004/0166743 | A1* | 8/2004 | Kurose | F21V 23/06 439/701 |
| 2007/0195527 | A1* | 8/2007 | Russell | F21S 8/06 362/240 |
| 2008/0019142 | A1* | 1/2008 | Rapeanu | H05K 1/18 362/555 |
| 2009/0045715 | A1* | 2/2009 | Shantha | H01J 5/60 313/51 |
| 2010/0097798 | A1* | 4/2010 | Young | F21V 29/83 362/235 |
| 2010/0284188 | A1* | 11/2010 | Chen | F21K 9/232 362/249.02 |
| 2011/0235322 | A1* | 9/2011 | Fields | F21V 7/0058 362/230 |
| 2012/0106203 | A1* | 5/2012 | Fricke | F21V 29/83 362/652 |
| 2013/0010463 | A1* | 1/2013 | Li | F21V 29/777 362/235 |
| 2013/0221846 | A1* | 8/2013 | Alexiou | F21K 9/69 315/51 |
| 2015/0198317 | A1* | 7/2015 | Feller | F21V 23/06 362/249.01 |
| 2015/0323142 | A1* | 11/2015 | Shigematsu | F21K 9/61 362/235 |
| 2017/0030530 | A1 | 2/2017 | Roys | |
| 2018/0106458 | A1* | 4/2018 | Sowden | F21V 3/02 |
| 2018/0156440 | A1* | 6/2018 | Eggink | F21V 23/005 |

* cited by examiner

MODULAR LED LAMP SYSTEM

RELATED APPLICATIONS

This application claims the benefit of U.S. Prov. Pat. App. No. 62/838,105, filed Apr. 24, 2019, and is a divisional application of U.S. Design patent application Ser. No. 29/650,957, filed Jun. 11, 2018, both of which are hereby incorporated by reference.

TECHNICAL FIELD OF THE INVENTION

The present invention relates to light emitting diode (LED) lighting and, in particular, to LED corn lamps.

BACKGROUND OF THE INVENTION

An LED corn lamp is an assembly of LEDs, typically on a metal structure. The term "corn light" was coined because the multiple LEDs look like corn kernels on a corn cobb. LED corn lamps can provide a very bright light by using a large quantity, sometimes hundreds, of LEDs. The "cobb" provides a heat sink that can maintain an operating temperature for a large number of LEDs. Because of their brightness, energy efficiency, and long lifetime, LED corn lights are replacing metal halide and high-pressure sodium lamps in many applications, such as outdoor lighting in commercial establishments and parking lots. Corn lamps are made to fit into a variety of screw sockets, including E40, E27, E39, and E26-stype sockets. Corn lamps typically include a housing section with a transformer that converts AC line voltage from a socket to a DC voltage suitable to power the LEDs, which may be positioned on plates extending from the base. For example, US Pat. Pub. No. 20120140517 describes such a corn lamp.

When a user purchases a corn light, it can be difficult to judge the brightness required for a particular application. If the user estimates the required brightness incorrectly, he must typically replace the corn light, and the used corn light typically cannot be returned to the seller.

SUMMARY OF THE INVENTION

An object of the invention is to provide a modular LED system that can provide a desired brightness by adding or removing modules.

A modular LED lamp system allows for combining multiple LED carriers to provide the desired amount of light. Each LED carrier preferably includes its own transformer to convert line voltage to power useable by the LEDs on the carrier. Line voltage is conducted through each module to a subsequent module and is provided to each transformer.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which.

DETAILED DESCRIPTION OF PREFERRED EMBODIMENTS

Embodiments of the present invention provide a modular LED lamp and a system and method of LED lighting. Modules can be added or removed to increase or decrease the quantity of light or other characteristics, of the emitted light, such as frequency combinations, thereby allowing a user to produce brightness desired. Modules with different properties, such as emission spectra, can be combined to produce a desired spectrum at a desired brightness. If, for example, an assembly emits insufficient light, additional modules can be added to the assembly to increase the light output, that is, the brightness. The assembly is preferably waterproof so that it can be used in outdoor applications, that is, a waterproof seal is formed between the assembled modules.

In some embodiments the assembly may include a bottom module that is inserted into a socket, a number of intermediate modules, the number being adjustable to change the number of LEDs in the assembly, and a top module, that provides a waterproof top to the assembly and on which additional LEDs may or may not be mounted. Line voltage is transferred from the socket to each of the modules on which LEDs are mounted. Each module on which LEDs are mounted preferably includes a transformer outputting power appropriate for the LEDs on that module. "Appropriate power" means a voltage type with sufficient current to operate the LED. For example, while fully rectified 24 Volt direct current is preferred, half rectified or even alternating current may be used to power LEDs, although with less efficiency. In some embodiments, only line voltage is transferred between modules, with the DC voltage being generated within each component to supply the LEDs on that component.

Including a transformer in each module allows an individual module to be removed and replaced if its transformer fails, instead of having to replace the entire lamp assembly. Moreover, including a transformer in each module spreads the heat produced by the transformer over a broader area of multiple modules, reducing the rise in temperature and extending the lives of the transformers.

In some embodiments, the line voltage, such as 110V AC, 60 Hz in the United States or 220 VAC, 50 Hz in Europe, is supplied through an Edison screw base, although the invention is not limited to any particular type of line voltage or socket.

The description and drawings below illustrate one embodiment of an adjustable lamp module, and the invention is not limited to the embodiment described.

Figure 1:
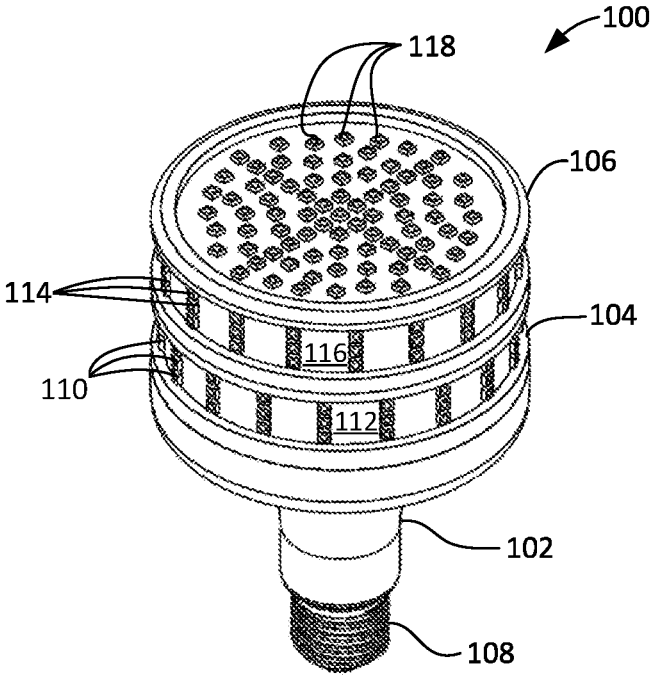
FIG. 1 shows an isometric view of a three-component LED lamp assembly including a base unit, an intermediate LED carrier, and a top LED carrier.

FIG. 1 is an isometric view of an LED lamp assembly 100, which comprises a base unit 102, an intermediate LED carrier 104, and a top LED carrier 106. Base unit 102 includes an Edison screw base 108 to electrically and mechanically connect LED lamp assembly 100 to a lamp socket (not shown). Intermediate LED carrier 104 includes LEDs 110 along its curved portion 112. Top LED carrier includes LEDs 114 along its curved portion 116 and LEDs 118 on the top surface 120.

Figure 2:
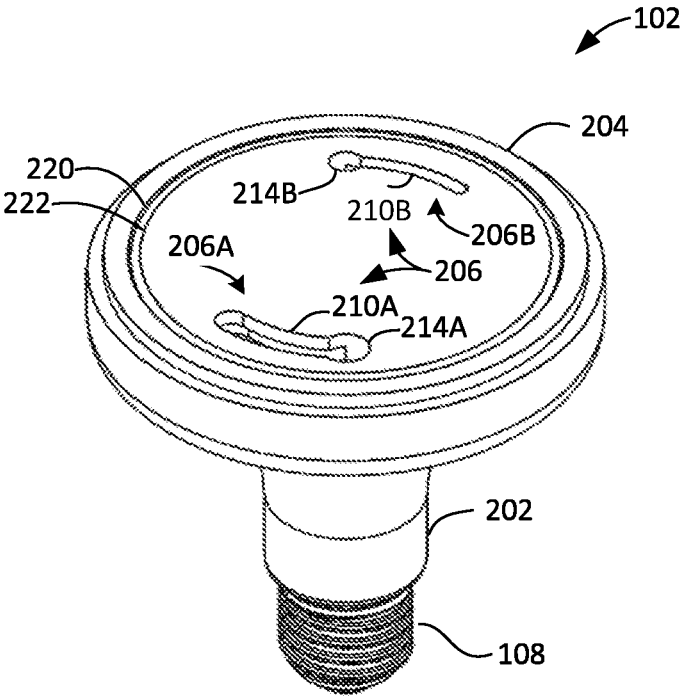
FIG. 2 shows an isometric view of the base unit of the three-component LED lamp assembly FIG. 1.

FIG. 2 is an isometric view of base unit 102, which includes a lower base portion 202 including the Edison screw base 108 and an upper base portion 204 that includes a two-part female connector 206 that includes connector portion 206A and connector portion 206B. Connector portion 206A includes a first arcuate slot 210A that terminates in a first hole 214A. Connector portion 206B includes a second arcuate slot 210B that terminates in a second hole 214B. A circular slot 220 seats an O-ring 222 that prevents water and other material from entering connecting portions 206A and 206B, preferably making the assembly 100 waterproof and weather tight for outdoor use.

Figure 3:
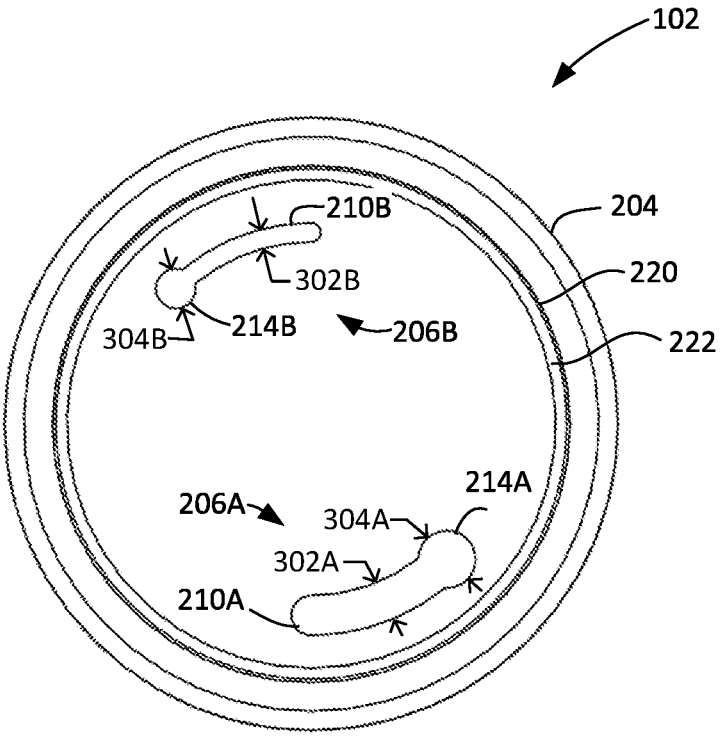
FIG. 3 shows a top view of the base unit of FIG. 2.

FIG. 3 shows a top view of base unit 102. First arcuate slot 210A has a width 302A that is greater than the width 302B of second arcuate slot 210B, and first hole 214A has a diameter 304A that is greater than the diameter 304B of second hole 214B. The difference in the diameters of holes 214A and 214B and the different widths of slots 210A and 210B act as a key to ensure proper polarity of the electrical connections between the base unit 102 and the LED unit immediately connected to the base.

Figure 4:
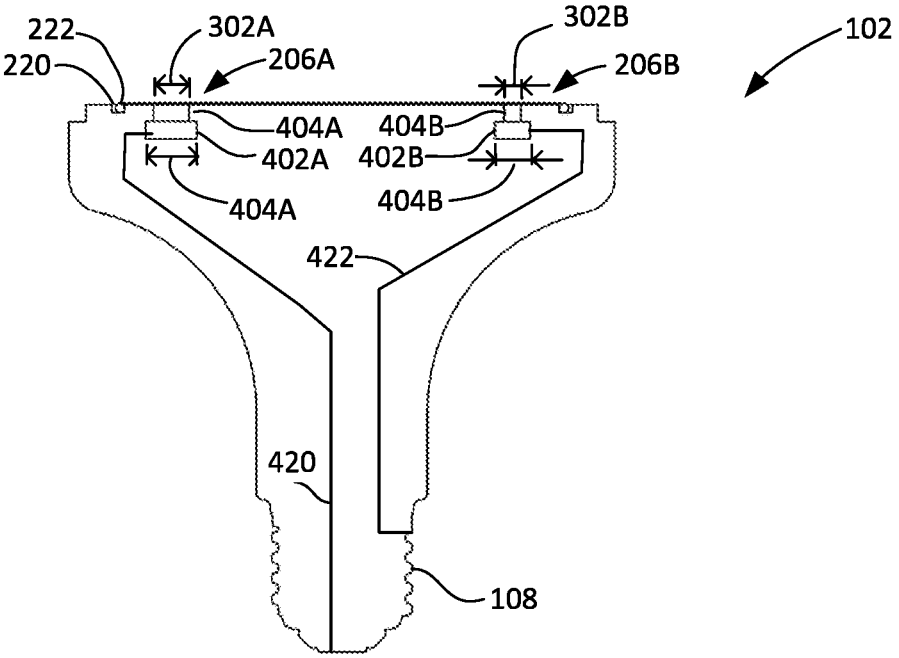
FIG. 4 shows a cross-sectional view of the base unit of FIG. 2.

FIG. 4 shows a cross section of base unit 102. The slots 210A and 210B include wider subsurface portions 402A and 402B, respectively, and a narrower open portion, 404A and 404B, respectively, that is open to the space above the base portion 102. Thus, connector portions 206A and 206B can be mated to a mating connector portions (not shown), to be described later, that are sized and shaped to fit into holes 214A and 214B and to move within slots 210A and 210B until the mating connectors portions mate with mating connectors within slots 210A and 210B. Base unit 102 includes an electrical conductor 420 that electrically connects the center contact on the Edison base 108 with an electrical contact (not shown) within slot 204A, and a conductor 422 that electrically connects the side contact on the Edison base 108 with an electrical contact (not shown) within slot 204B.

Figure 5:
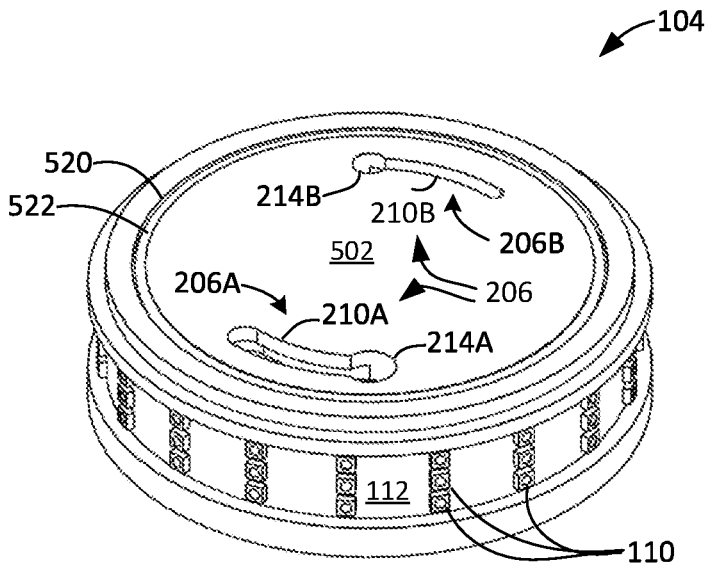
FIG. 5 shows an isometric view of the intermediate LED carrier of the LED assembly of FIG. 1.

FIG. 5 shows an isometric view of the intermediate LED carrier 104 of FIG. 1. Intermediate LED carrier 104 includes on its top surface 502 a connector 206 identical to connector 206 on the top surface of base unit 102. Thus, an intermediate LED carrier can be attached to a connector 206 on a base unit 102 or to a connector 206 on another intermediate LED carrier 104. A circular slot 520 seats an O-ring 222 that prevents water and other material from entering connector portions 206A and 206B, preferably making an LED lamp assembly that includes intermediate LED carrier 104 weather tight for outdoor use.

Figure 6:
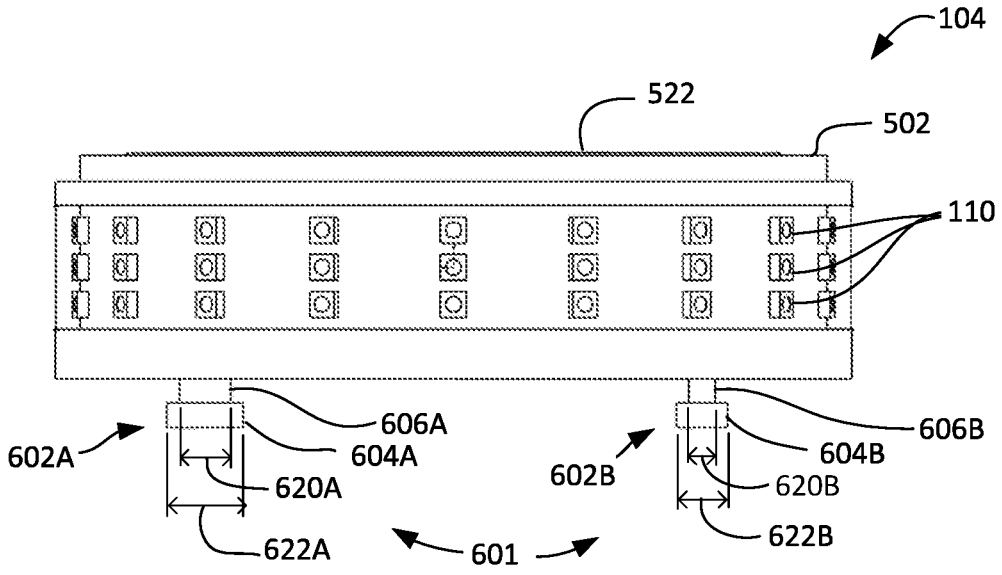
FIG. 6 shows a front elevation of the intermediate LED carrier of FIG. 5.

FIG. 6 shows a front elevation of the intermediate LED carrier 104 which shows a two-part male connector 601 for connecting to two-part female connector 206 on the top surface of base unit 102 or on the top surface 502 of another intermediate LED carrier 104. Connector 601 includes a first connector portion 602A and a second connector portion 602B, both extending from the bottom of intermediate LED carrier 104. Connector portion 602A comprises a disk 604A positioned at the distal end of a post 606A. Disk 604A has a diameter of 622A and post 606A has a diameter of 620A. Connector portion 602B comprises a disk 604B positioned at the distal end of a post 606B. Disk 604B has a diameter of 622B and post 606B has a diameter of 620B.

Figure 7:
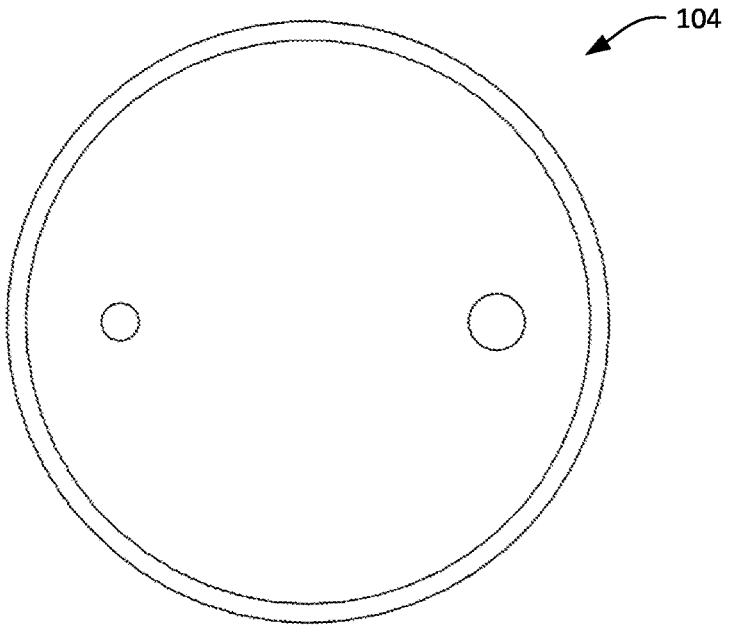
FIG. 7 shows a bottom view of the intermediate LED carrier of FIG. 5.

Disk 604A is sized to fit into hole 214A and to slide in subsurface portion 402A of slot 210A and disk 604B is sized to fit into hole 214B and to slide in subsurface portion 402A of slot 210B. Diameter 622A is larger than the width 302A of the open portion 404A of slot 210A so that when disk 604A is inserted into hole 214A and rotated in subsurface slot 402A, disk 604A cannot be moved vertically out of slot 210A. Disk 604A is therefore mechanically trapped in the slot 210A. Similarly, diameter 622B is larger than the width 302B of the open portion 404B of slot 210B so that when disk 604B is inserted into hole 214B and rotated in subsurface slot 402B, disk 604B cannot be moved vertically out of slot 210B. Disk 604B is therefore mechanically trapped in the slot. Intermediate LED carrier can therefore be mounted onto a base unit 102 or onto another intermediate carrier 104. Posts 606A and 606B make electrical contact with mating connectors (not shown) within slots 210A and 201B. FIG. 7 shows a bottom view of intermediate LED carrier 104, with disks 604A and 604B extending from bottom surface 702.

Figure 8:
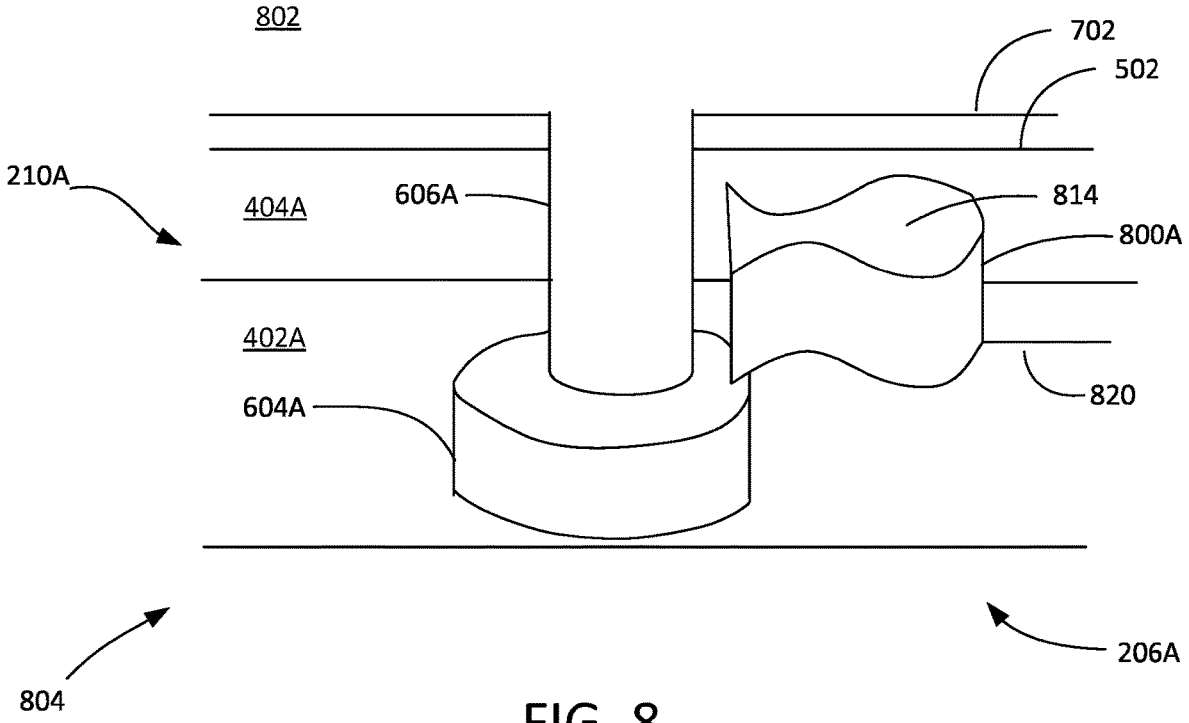
FIG. 8 shows a cross section of two LED assembly components and one method of formation of an electrical contact between them.

FIG. 8 shows an upper component 802 which could be, an intermediate LED carrier 104 or a top LED carrier 106, which includes a post 606A with disk 604A. FIG. 8 also includes a lower component 804, which could be an intermediate LED carrier 104 or a base unit 102, which includes a slot 210A composed of subsurface portion 402A and open portion 404A. An electrical contact 800A is positioned within slot 210A and electrically connects to, and mechanically retains, post 606A.

As upper component 802 is rotated relative to lower component 804, post 606A will rotate into electrical contact 800A. Electrical contact 800A is made of a springy material and includes a constricted portion 812 which is spread apart as post 606A enters the contact and then springs back as post 606A passes and enters a wider portion 814. Post 606A is thereby retained by the spring force of electrical contact 800A. A wire 820 provides an electrical path from clip 804 to other circuit components. A similar electrical contact, 800B (not shown), is positioned in slot 201B and electrically connects to, and mechanically retains, post 606B. The electrical contact 800B is similar to electrical contact 800A, but electrical contact 800B is smaller to accommodate smaller post 606B. Electrical connectors 800A and 800B are preferably electrically isolated from the body of lower component 804.

The connection between upper component 802 and lower component 802 should be sufficiently firm and tight so that O-ring 222 can create a weather tight seal between the components and to produce good electrical contact between post 606A and contact 800A. For example, subsurface slot 402A may be shaped to force post 606A downward as it moves into the slot, thereby forcing upper component 802 closer to lower component 804 and compressing O-ring between the components to form a watertight seal. Any type of mechanical and electrical connector that provides an electrical contact and retains the upper and lower component in a weather tight seal could be used.

Figure 9:
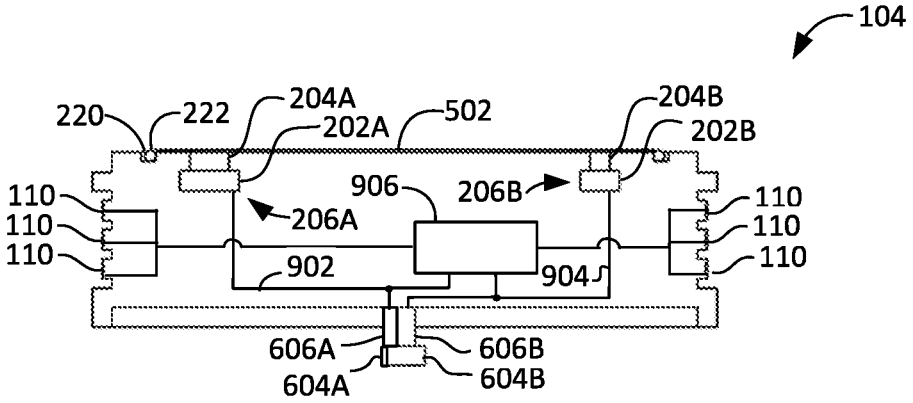
FIG. 9 shows a cross section of the intermediate LED carrier of FIG. 5.

FIG. 9 shows a cross section of intermediate LED carrier 104. The interior of slots 210A and 210B are visible near the top of intermediate LED carrier 104. Extending from the bottom of intermediate LED carrier 104, post 606B and disk 604B are visible and post 606A and disk 604A are partly visible. Intermediate LED carrier 104 includes an electrical conductor 902 that connects post 606A to electrical connector 800A (FIG. 8) and an electrical conductor 904 that connects post 606B to electrical connector 800B (not shown), thereby supplying line voltage received from a component below the intermediate LED carrier 104 to the component or components above the intermediate LED carrier 104. Intermediate LED carrier 104 also includes a transformer 906 receiving line voltage from connectors 602A and 602B and outputting appropriate power, such as a low voltage direct current, for example, 24 VDC, for powering the LEDs 110.

Figure 10:
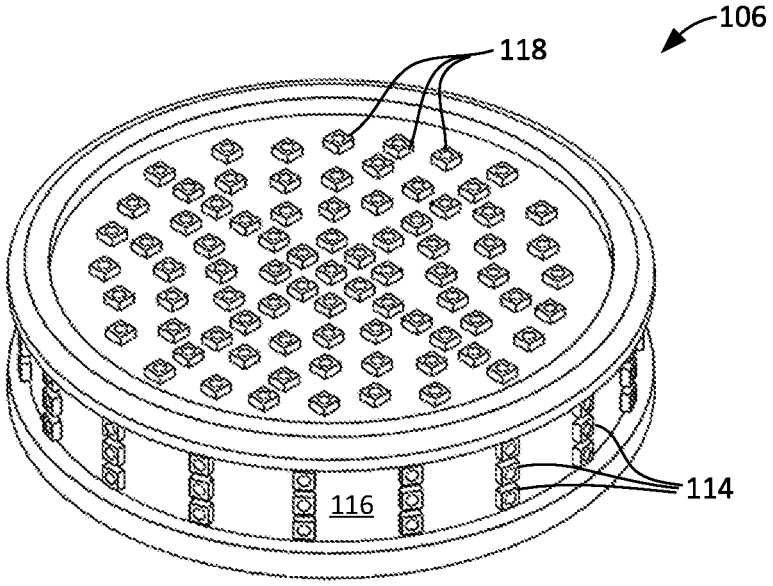
FIG. 10 shows an isometric view of a top LED carrier of FIG. 1.
Figure 11:
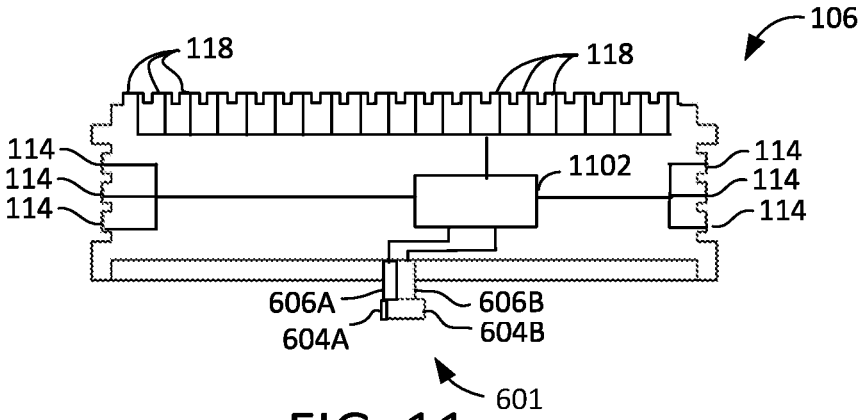
FIG. 11 shows a side cross-section of the top LED carrier of FIG. 10.

FIG. 10 shows an isometric view of a top LED carrier 106 having LEDs 114 on its curved side surface and LEDs 118 on its top surface. FIG. 11 shows a cross section of the top LED carrier 106. Posts 606A and 606B provide AC line voltage to a transformer 1102 which provides a low voltage direct current output to LEDs 114 and LEDs 118. Transformer 1102 may have a different output power than transformer 806 in intermediate LED carrier because there are more LEDs on top LED carrier 106 than there are on intermediate LED carrier 104.

Figure 12:
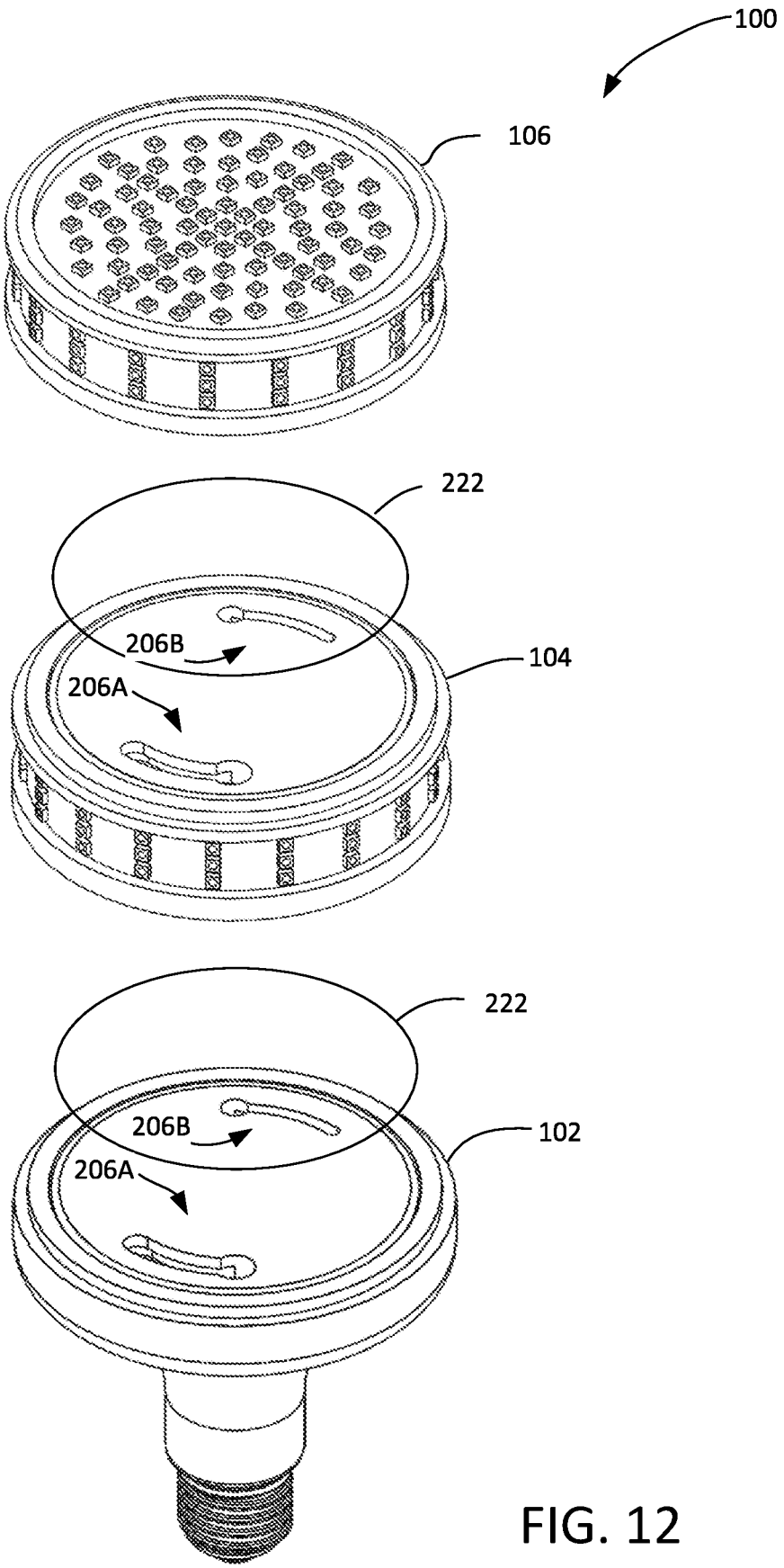
FIG. 12 shows an exploded view of the LED assembly of FIG. 1.

FIG. 12 shows an exploded isometric view of the LED lamp assembly 100 of FIG. 1 including a base unit 102, an intermediate LED carrier 104, and a top LED carrier 106 with O-rings 222 between the components. The base unit 102, an intermediate LED carrier 104, and a top LED carrier 106 are connected using connectors 206A and 206B on the top surfaces of base unit 102 and intermediate LED carrier 104, mating with connectors 602A and 602B (neither visible) on the bottom of intermediate LED carrier 104 and top LED carrier 106.

Figure 13:
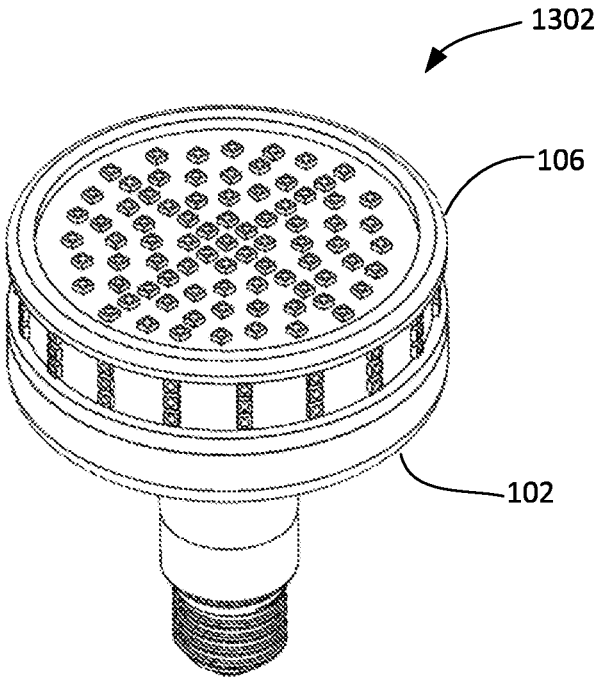
FIG. 13 shows an isometric view of an LED assembly including a bottom unit and a top LED carrier.
Figure 14:
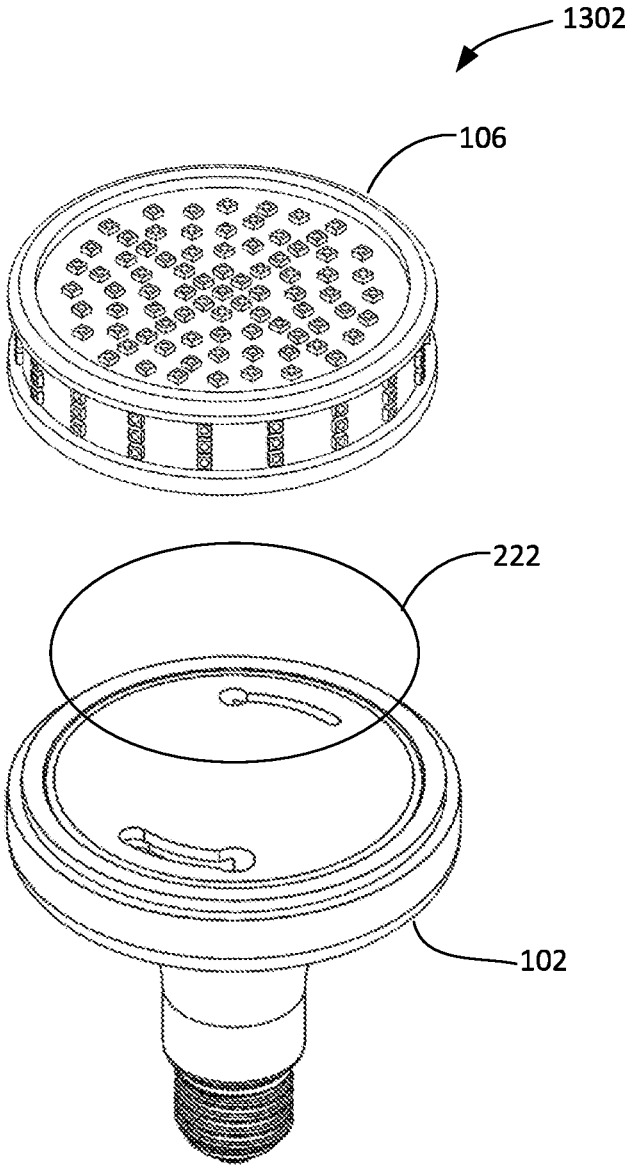
FIG. 14 shows an exploded view of the LED assembly of FIG. 13.

FIG. 13 shows an isometric view of LED assembly 1302 with a base unit 102 and a top LED carrier 106, without an intermediate LED carrier 104. FIG. 14 shows an exploded view of the LED assembly 1302.

Figure 15:
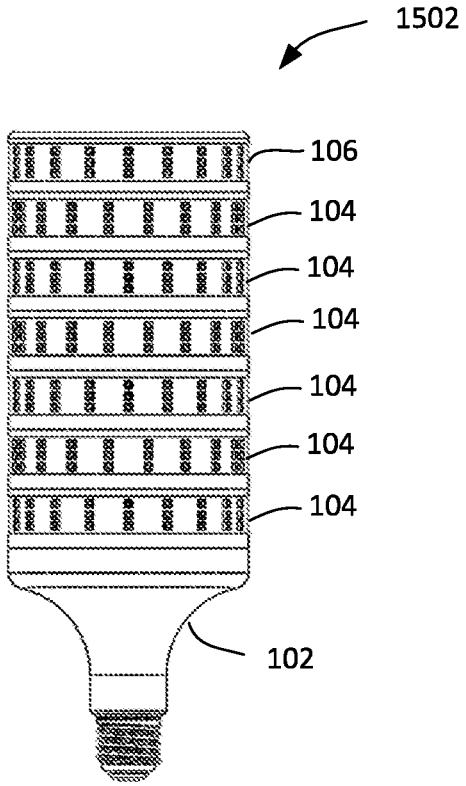
FIG. 15 shows a front elevation of an LED assembly including a bottom unit, six intermediate LED carriers, and a top LED carrier.

Any number of intermediate LED carriers 104 can be stacked to make an LED lamp assembly to produce the desired brightness, limited only by the amount of electrical current that can be carried through the Edison base and other connectors. For example, FIG. 15 shows an LED lamp assembly 1502 comprising a bottom unit 102, six intermediate LED carriers 104, and a top LED carrier 106.

Figure 16:
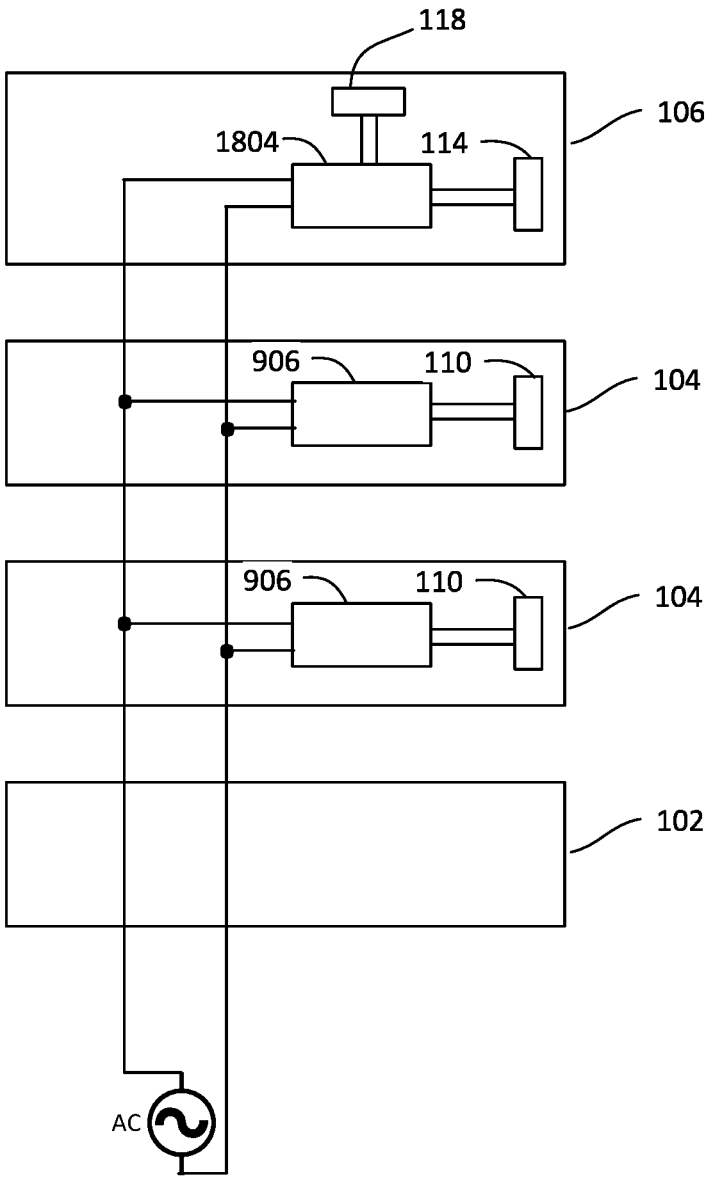
FIG. 16 is an electrical schematic of the LED assembly of FIG. 1.

FIG. 16 shows schematically an LED lamp assembly having a base unit 102, two intermediate LED carriers 104, and a top LED carrier 106. Line AC voltage is connected to base unit 102 through the Edison screw base and passes through base unit 102 to each of the subsequent intermediate LED carriers 104 and to top LED carrier 106. Each of intermediate LED carriers 104 includes a transformer 906, which converts the line voltage to appropriate voltage for LEDs 110. Top LED carrier 106 includes a transformer 1102 that converts the line voltage to an appropriate voltage for LEDs 114 and 118.

Figure 17:
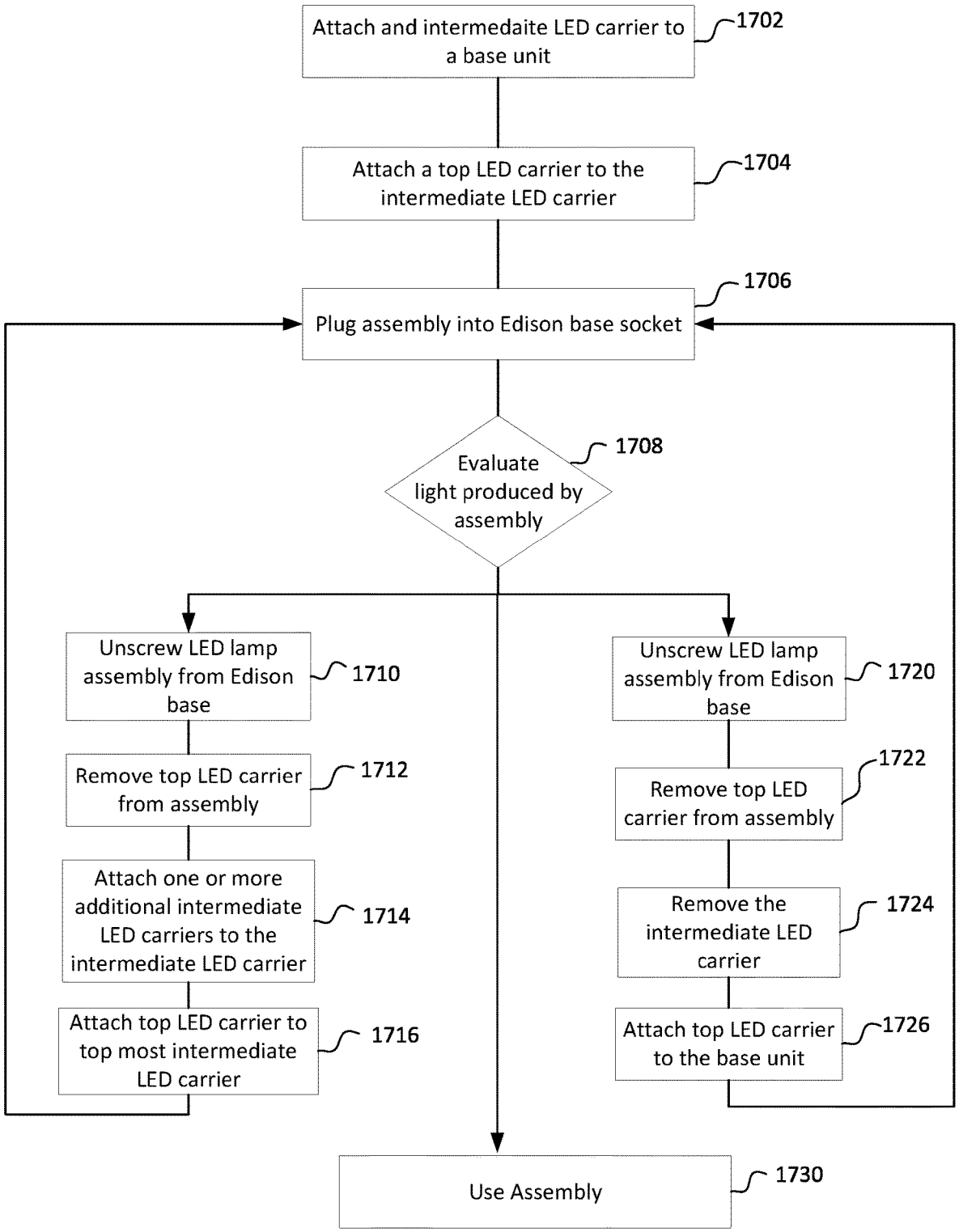
FIG. 17 is a flow chart showing a process of using a modular LED assembly.
Figure 18:
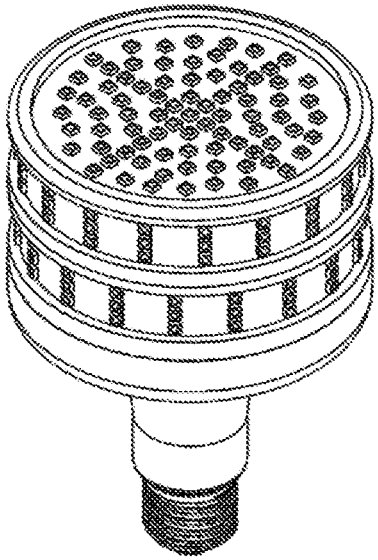
FIG. 18 is an isometric view of a stackable modular corn light assembly in accordance with my new design, the stackable modular corn light assembly including a base module, a center LED module, and a top LED module.
Figure 19:
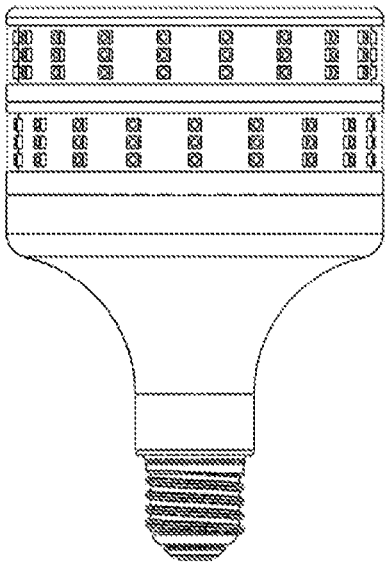
FIG. 19 is front elevation thereof.
Figure 20:
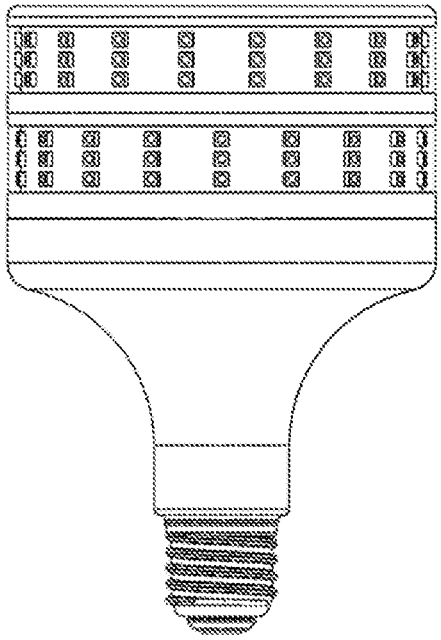
FIG. 20 is rear elevation thereof.
Figure 21:
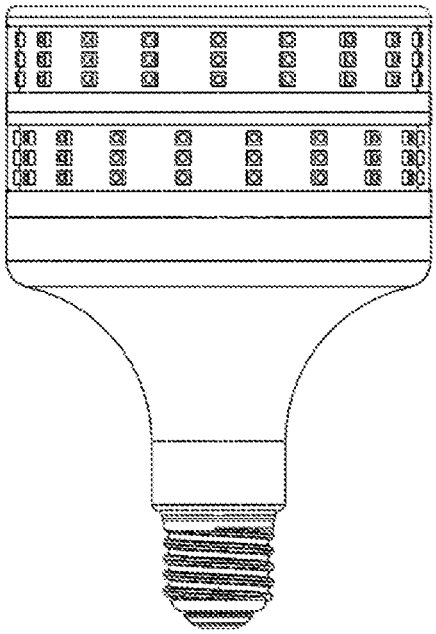
FIG. 21 is a left side elevation thereof.
Figure 22:
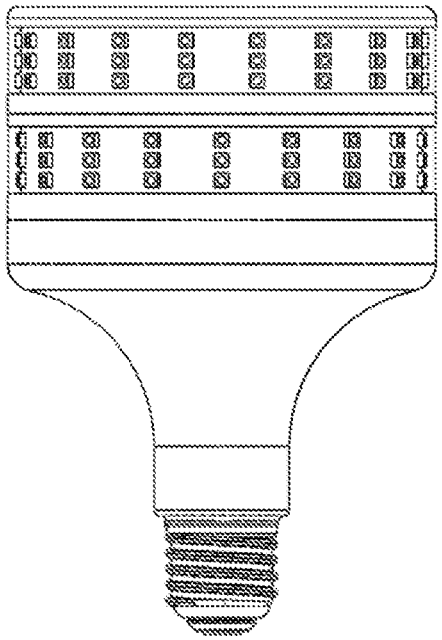
FIG. 22 is a right side elevation thereof.
Figure 23:
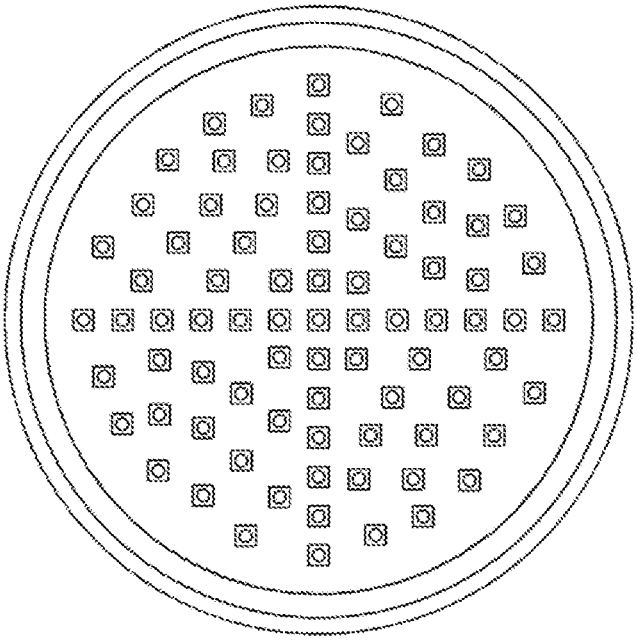
FIG. 23 is a top plan view thereof.
Figure 24:
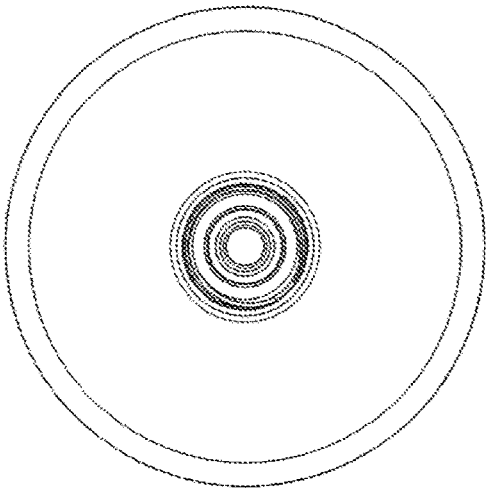
FIG. 24 is a bottom plan view thereof.
Figure 25:
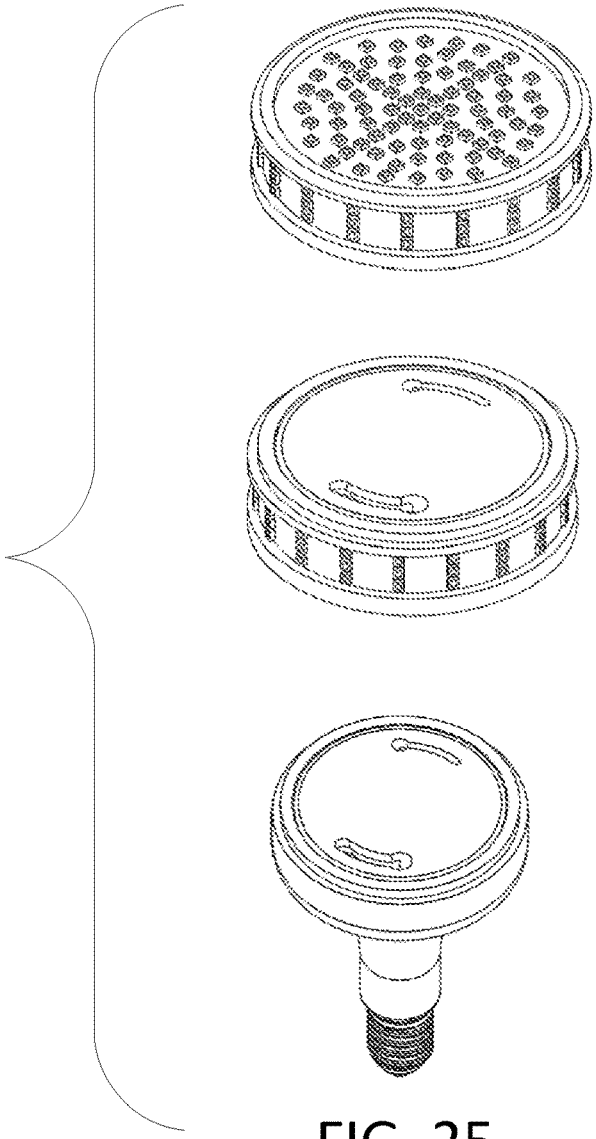
FIG. 25 is an exploded view of the stackable modular corn light assembly of FIG. 18.
Figure 26:
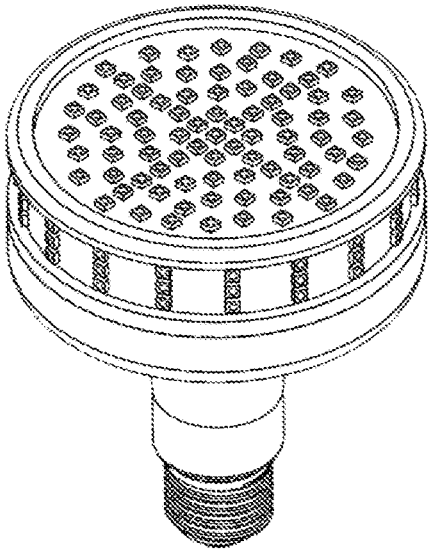
FIG. 26 is an isometric view of a stackable modular corn light assembly in accordance with my new design, including a base module and a top LED module.
Figure 27:
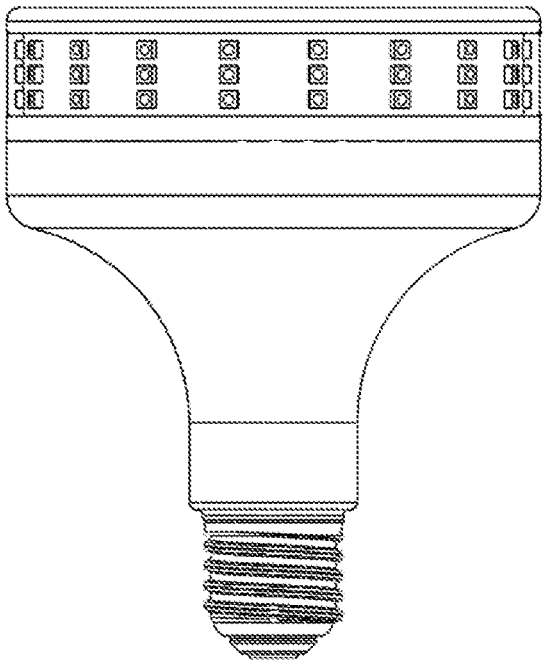
FIG. 27 is front elevation thereof.
Figure 28:
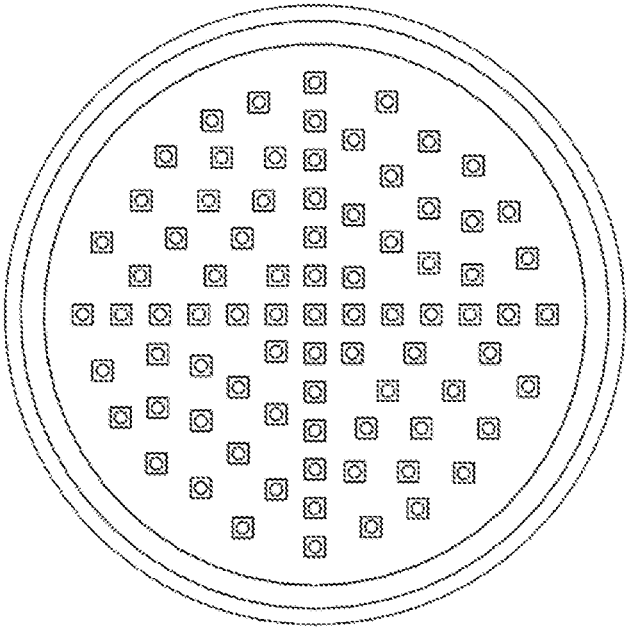
FIG. 28 is a top plan view thereof.
Figure 29:
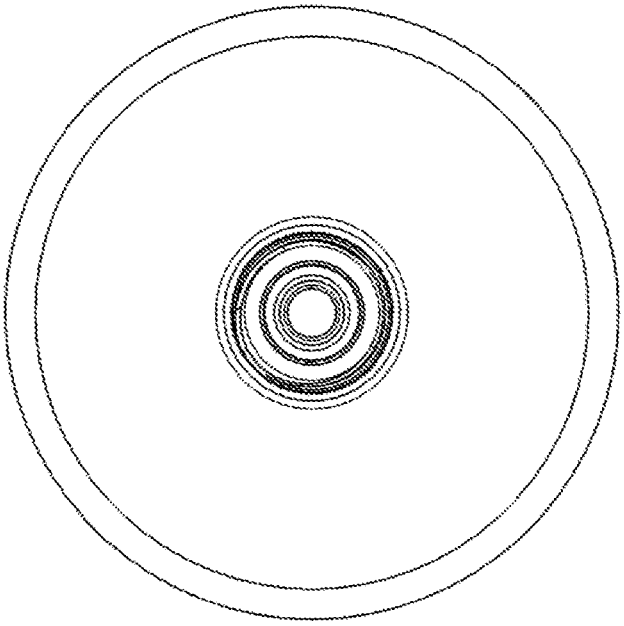
FIG. 29 is a bottom plan view thereof.
Figure 30:
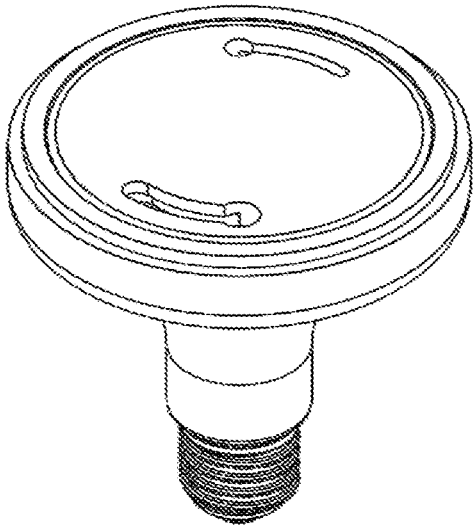
FIG. 30 is an isometric view of a base module of the stackable modular corn light assembly of FIGS. 18-29.
Figure 31:
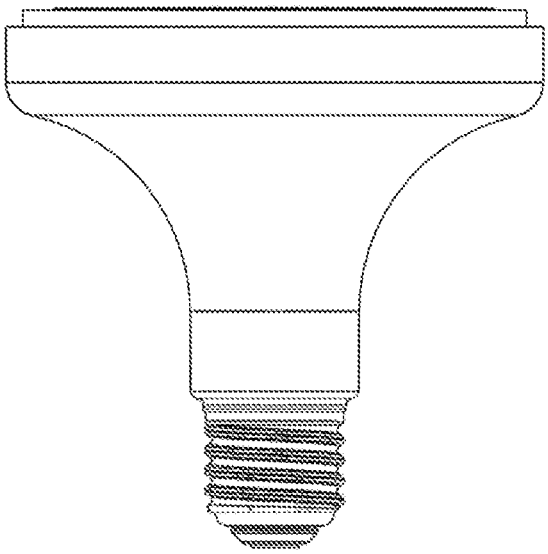
FIG. 31 is a front elevation of the base module.
Figure 32:
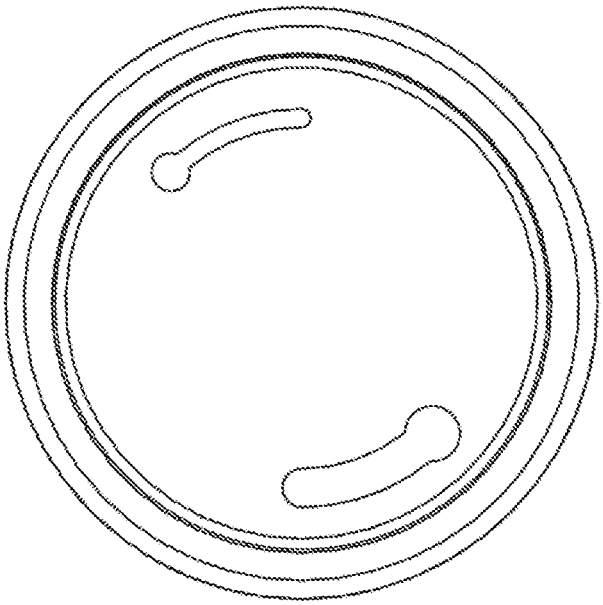
FIG. 32 is a top plan view of the base module.
Figure 33:
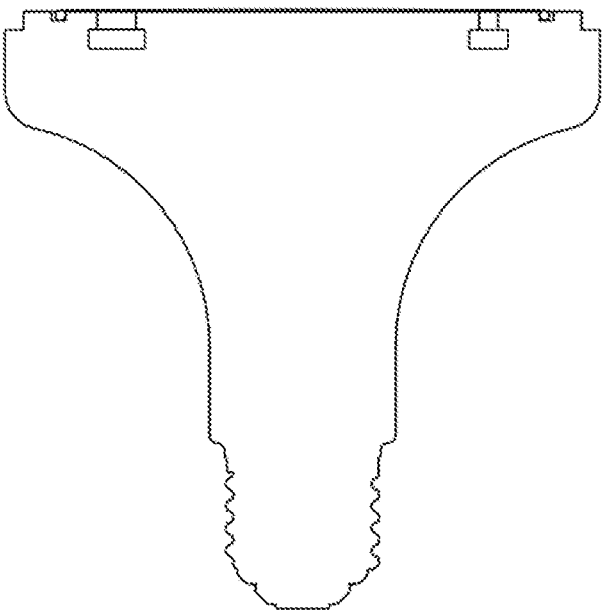
FIG. 33 is a cross-sectional view of the base module.
Figure 34:
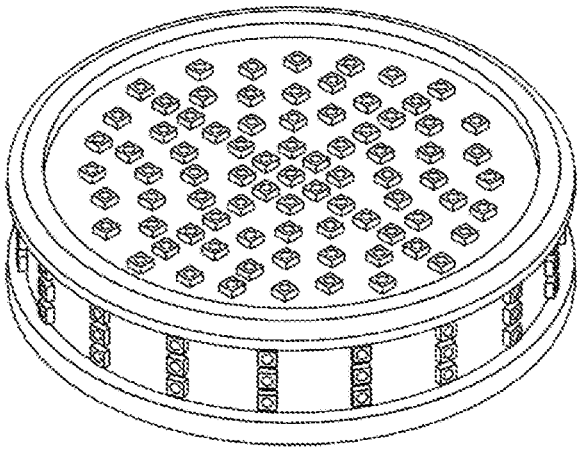
FIG. 34 is an isometric view of a top LED module of the stackable modular corn light assembly of FIGS. 18-29.
Figure 35:
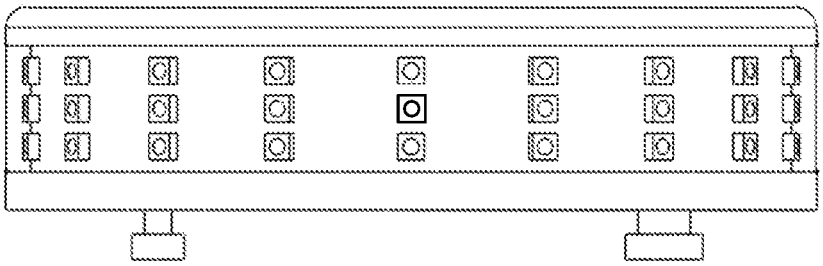
FIG. 35 is a front elevation of the top LED module.
Figure 36:
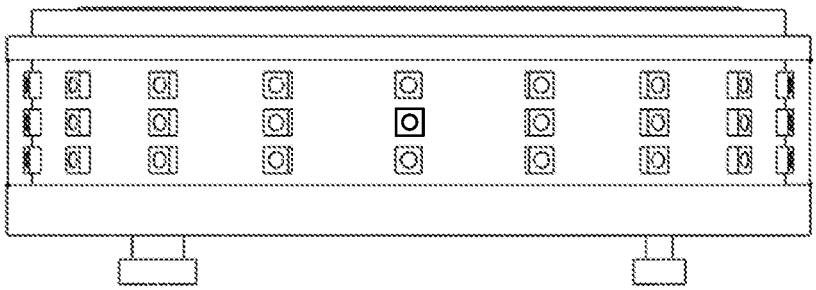
FIG. 36 is rear elevation of the top LED module.
Figure 37:
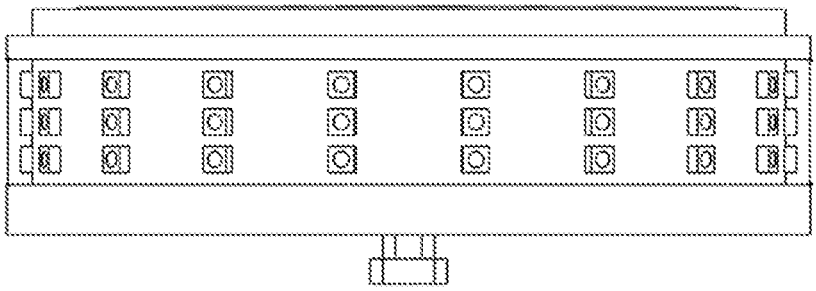
FIG. 37 is a left side elevation of the top LED module
Figure 38:
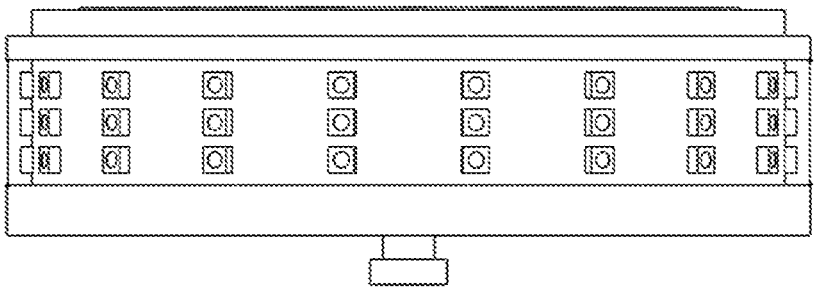
FIG. 38 is a right side elevation of the top LED module
Figure 39:
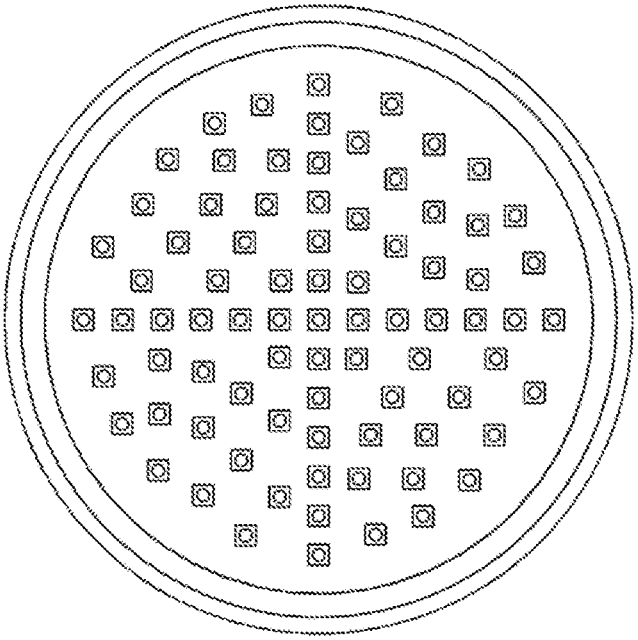
FIG. 39 is a top plan view of the of the top LED module
Figure 40:
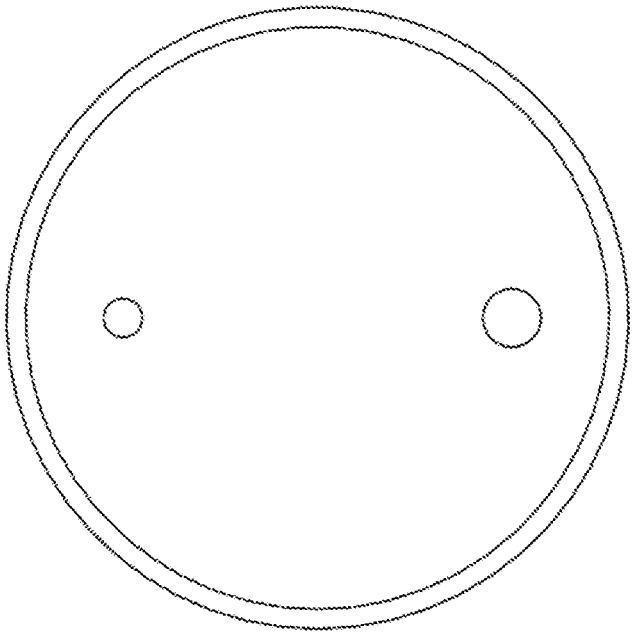
FIG. 40 is a bottom plan view of the of the top LED module.
Figure 41:
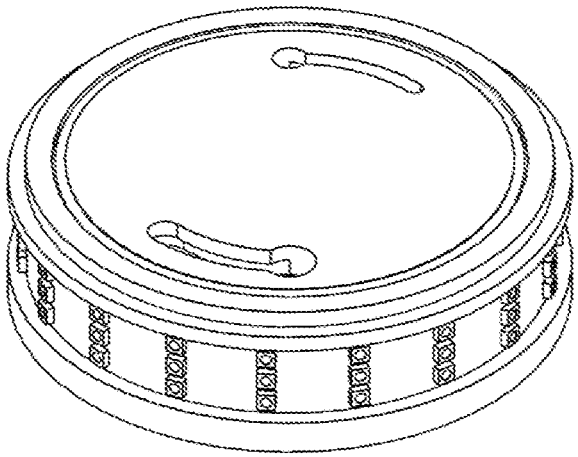
FIG. 41 is an isometric view of a center LED module of the stackable modular corn light assembly of FIGS. 18-29.
Figure 42:
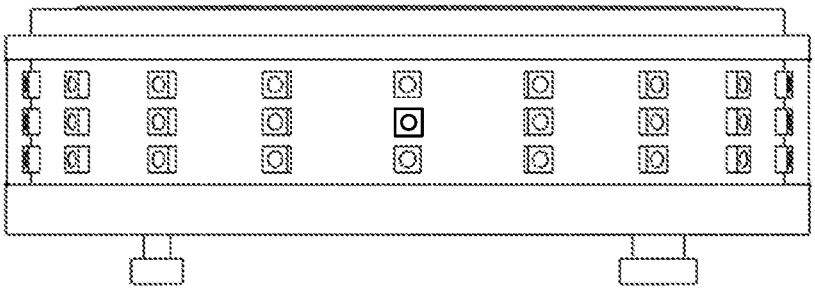
FIG. 42 is a front elevation of the center LED module.
Figure 43:
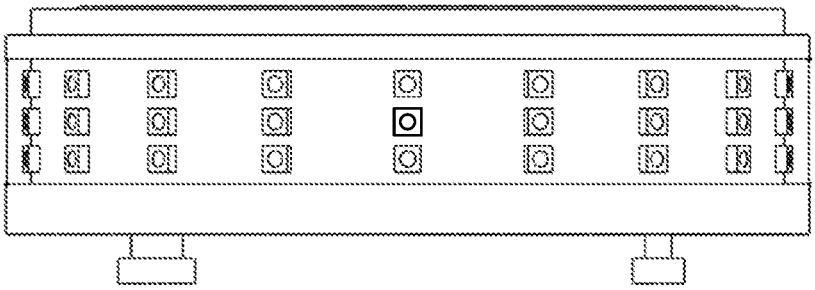
FIG. 43 is a rear elevation of the center LED module.
Figure 44:
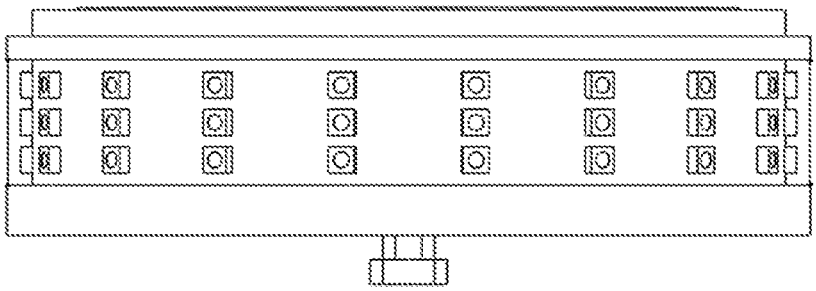
FIG. 44 is a left side elevation of the center LED module.
Figure 45:
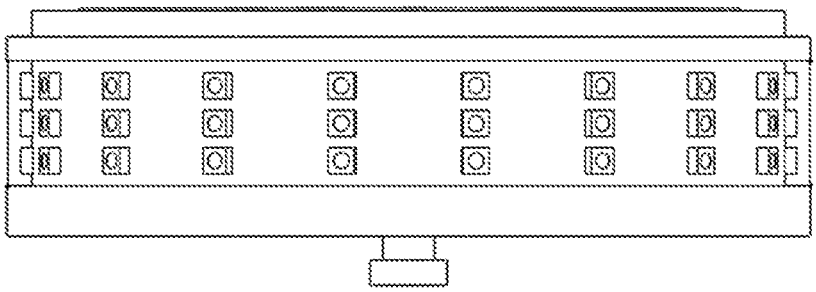
FIG. 45 is a right side elevation of the center LED module.
Figure 46:
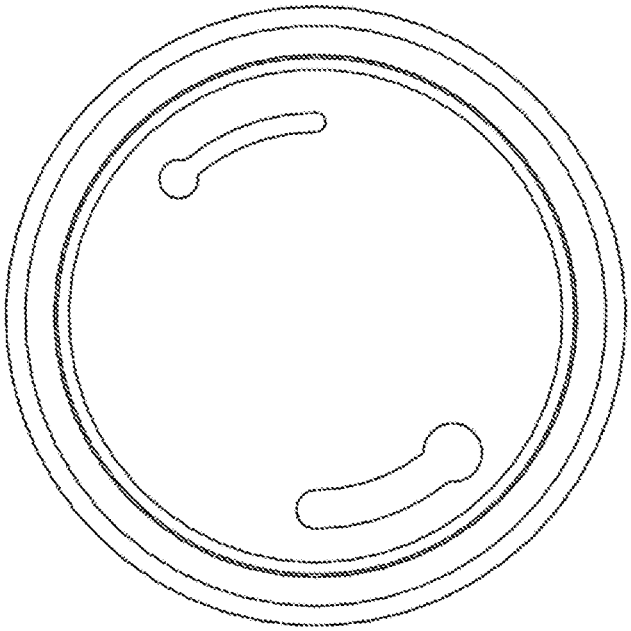
FIG. 46 is a top plan view of the of the center LED module.
Figure 47:
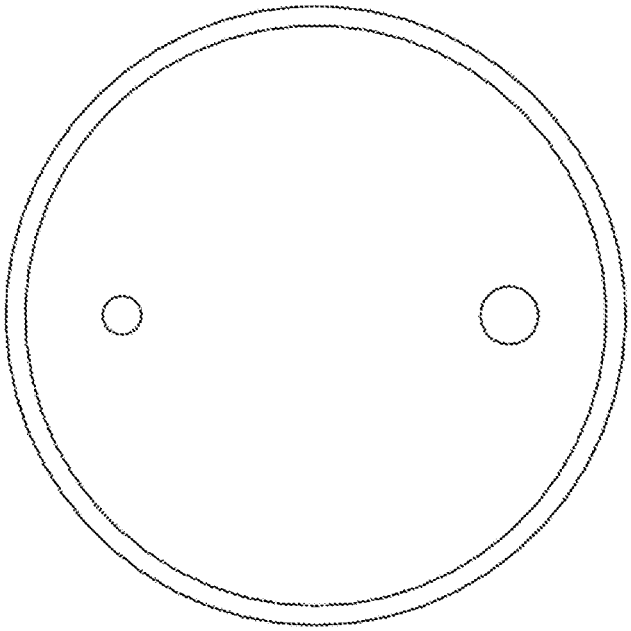
FIG. 47 is a bottom plan view of the of the center LED module.
Figure 48:
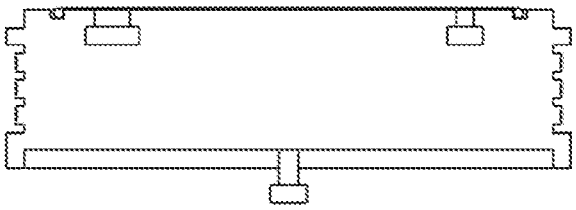
FIG. 48 is a cross-sectional view of the center LED module.
Figure 49:
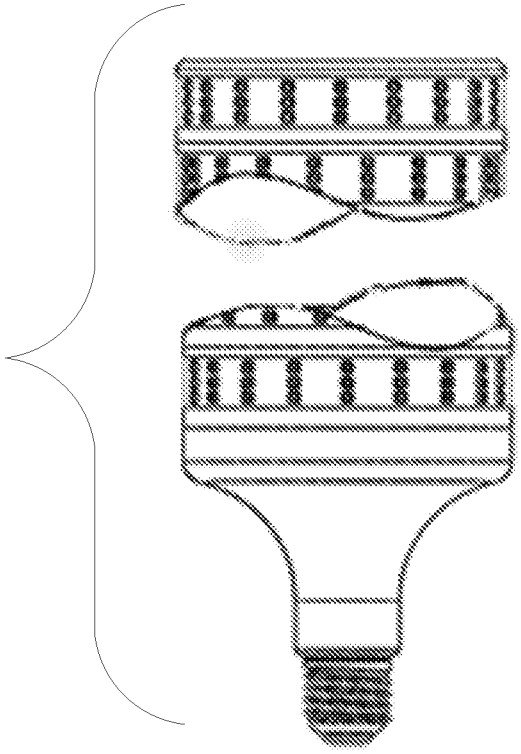
FIG. 49 is a front view of a stackable modular corn light assembly in accordance with my new design, stackable modular corn light assembly including the base module of FIG. 30-33, the center LED module of FIGS. 41-48, and the top LED module of FIGS. 34-40.
Figure 50:
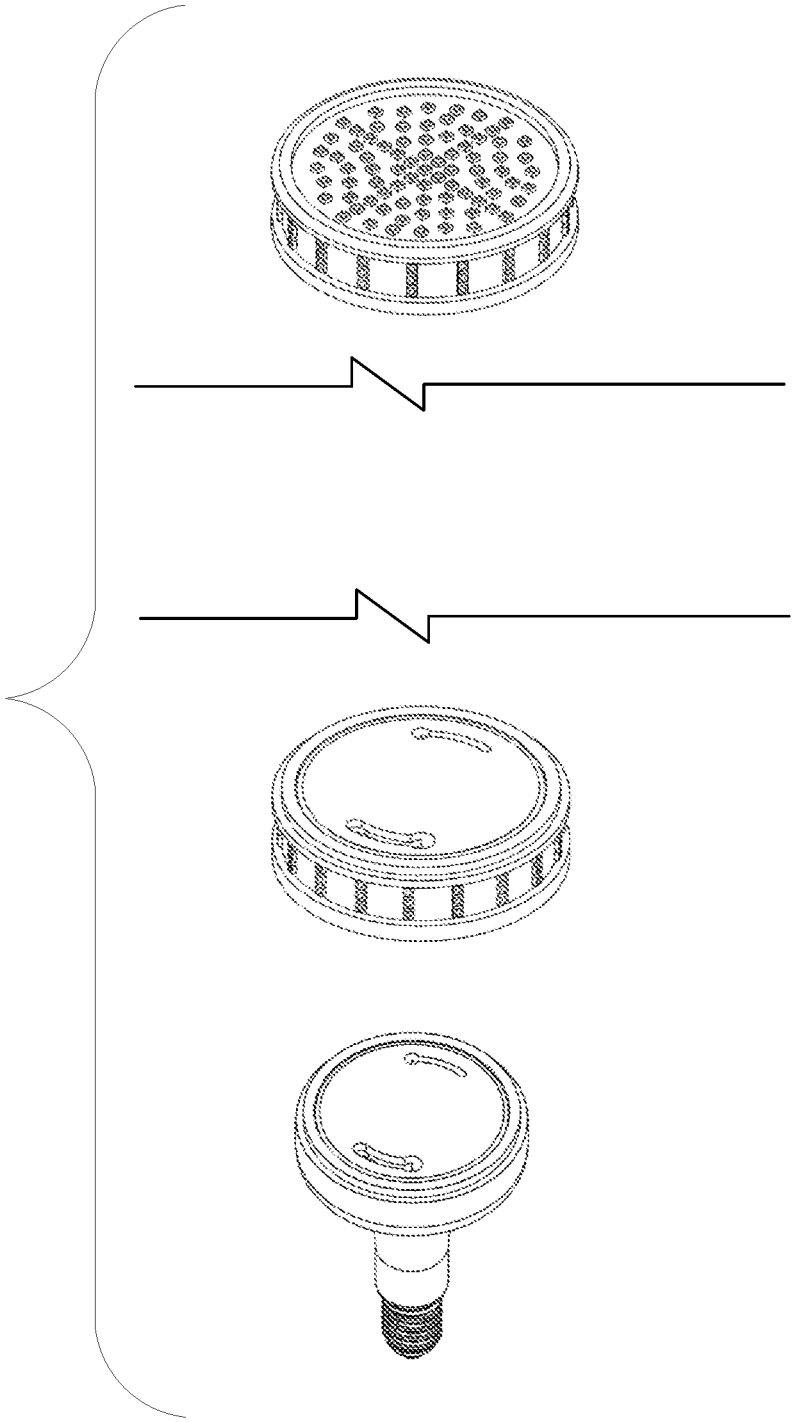
FIG. 50 shows an exploded view of the stackable modular corn light assembly of FIG. 49.
Figure 51:
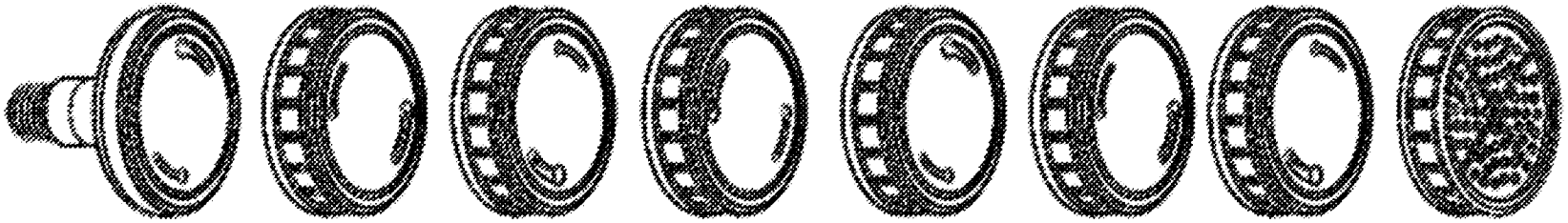
FIG. 51 shows an example of a stackable corn light assembly, the example comprising the base module of FIG. 30-33, six center LED modules of FIGS. 41-48, and the top LED module of FIGS. 34-40.

FIG. 17 is a flow chart showing the steps of assembling a suitable LED Lamp assembly. In step 1702, an intermediate LED carrier 104 is attached to a base unit 102 by inserting disk connectors disks 604A and 604B of LED intermediate carrier 104 into holes 214A and 214B in the base unit 102 and rotating the LED intermediate carrier 104 until the posts 606A and 606B of the intermediate LED carrier seat in the mating connectors 800A and 800B in the base unit. In step 1704, a top LED carrier 106 is attached to the intermediate LED carrier 104 by inserting disk 604A and 604B of top LED carrier 106 into holes 214A and 214B in the intermediate LED carrier 104 and rotating the top LED carrier 104 and the intermediate LED carrier relative to each other until posts 606A and 606B seat in the mating connectors 800A and 800B in the intermediate LED carrier 104.

In step 1706, the assembled LED lamp is plugged into an Edison screw base. In decision block 1708, the output of the lamp is evaluated to determine whether or not the lamp produces sufficient light having the desired characteristics. If the LED lamp is producing insufficient light, step 1710 shows that the LED assembly is removed from its socket to disconnect it from the power source. In step 1712, the top LED carrier 106 is removed by rotating it to disconnect it from the intermediate LED carrier below it. In step 1714, one or more additional intermediate LED carriers are attached to the existing LED intermediate carrier. In some embodiments, for example, in step 1716, the top LED carrier is attached to the top-most LED intermediate carrier. The LED assembly is then plugged into the Edison base as the process repeats from step 1706.

If in decision block 1708 it is determined that the lamp is producing too much light, then in step 1720, the LED assembly is unscrewed from the Edison screw base to disconnect the LED lamp assembly from the power source. In step 1722 the top LED carrier is removed from the intermediate LED carrier 104. In step 1724, one or more intermediate LED carriers are removed from the assembly. In step 1726, the top LED carrier is attached to base unit 102 or to the top-most of the remaining intermediate LED carriers. The process then continues with step 1706.

If in block 1708 it is determined that the desired light emission is achieved, the assembly is used in step 1730 in the Edison socket for the lighting application.

In some embodiments, intermediate LED carrier 104 can come in multiple varieties, with different quantities and/or colors of LEDs. This allows a lamp assembly to be assembled to provide the required amount and color of light. For example, if an assembly having an intermediate bases produces too little light and an assembly with n+1 intermediate bases produces too much light, an intermediate base with fewer LEDs could be used to substitute for an intermediate LED carrier having more LEDs.

In some embodiments, instead of a top LED carrier, a cap without LEDs can be used to create a weather tight seal with the intermediate LED carrier. In some embodiments, the base unit can also include a transformer and LEDs. The term "LED carrier" refers to any component on which LEDs are mounted, such as the intermediate LED carrier or a top LED carrier.

While the intermediate and top LED carriers described herein are cylindrical, i.e., they have circular cross sections, the cross section can also be of other shapes, including polygons, such as triangular, rectangular (including square), hexagonal or octagonal. The LED carriers can be shaped as prisms having a polygonal base, for example, a triangular, rectangular (including square), hexagonal or octagonal base.

The base unit is described as including an Edison screw base, The base unit can include other types of connectors, such as bi-pin or recessed bi-pin bases, to mate with other types of connectors.

FIGS. 18-51 show designs of corn lights.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. A modular LED lamp assembly, comprising:

a base unit;

the base unit including an Edison screw connector for providing an electrical connection to a socket, the socket providing an alternating current at a line voltage, the base unit lacking a transformer;

a base unit connector on the side of the base unit opposite to the Edison screw connector, an intermediate LED carrier having a bottom surface, a top surface, and a side surface area, comprising:

multiple LEDs positioned on the side surface area;

an intermediate LED carrier bottom connector on the bottom surface of the intermediate LED carrier configured for mechanically and electrically connecting the intermediate LED carrier to the base unit and for receiving the alternating current at the line voltage;

a transformer for converting the alternating current supplied through the intermediate LED carrier bottom connector to direct current compatible with the multiple LEDs;

an intermediate LED carrier top connector on the top of the intermediate LED carrier configured to mechanically and electrically connect the intermediate LED carrier and for providing the alternating current at the line voltage, and in which the intermediate LED bottom connector supplies the alternating current to the transformer and to the intermediate LED carrier top connector, the base unit configured to provide the line voltage to the intermediate LED carrier, the intermediate LED carrier configured to accept the line voltage from the base unit, a top LED carrier having a bottom side in which is located a top LED carrier connector, a top side opposite to the bottom side, and a side surface area between the top side and bottom side; the top LED carrier including multiple LEDs mounted on the side surface area of the top LED carrier, and the top LED carrier connector configured to mechanically and electrically connect the top LED carrier to the intermediate LED carrier top connector, the top LED carrier including a transformer for converting the alternating current supplied through the top LED carrier connector to direct current compatible with the multiple LEDs mounted on the side surface area of the top LED carrier.

2. The modular LED lamp assembly of claim 1 in which the intermediate LED carrier is electrically and mechanically connected to the base unit by rotating the intermediate LED carrier or base unit relative to each other by less than 360 degrees.

3. The modular LED lamp assembly of claim 1 in which the intermediate LED carrier has at least one weather tight surface.

4. The modular LED lamp assembly of claim 1 in which the base unit, the intermediate LED carrier, and the top LED carrier are mechanically connected by weather tight mechanical connections.

5. The modular LED lamp assembly of claim 1 further comprising an additional intermediate LED carrier positioned between the top LED carrier and the base unit.

* * * * *